US008434527B2

(12) United States Patent
Welz et al.

(10) Patent No.: US 8,434,527 B2
(45) Date of Patent: May 7, 2013

(54) SEAT BELT WEBBING AND METHOD FOR MANUFACTURING THE SAME

(75) Inventors: Willibert Welz, Veghel (NL); Chris van Helvoort, Boxtel (NL); Anita Pool, Eindhoven (NL); Simon Valkenburg, Hamburg (DE)

(73) Assignee: Autoliv Development AB, Vargarda (SE)

( * ) Notice: Subject to any disclaimer, the term of this patent is extended or adjusted under 35 U.S.C. 154(b) by 139 days.

(21) Appl. No.: 13/018,545

(22) Filed: Feb. 1, 2011

(65) Prior Publication Data

US 2012/0192988 A1 Aug. 2, 2012

(51) Int. Cl.

| | |
|---|---|
| ***D03D 43/10*** | (2006.01) |
| ***D03D 47/42*** | (2006.01) |
| ***D03D 47/44*** | (2006.01) |
| *D03D 49/50* | (2006.01) |

(52) U.S. Cl.

USPC ..... 139/431; 139/432; 139/442; 139/170.7; 139/195

(58) Field of Classification Search ..... 139/11, 139/20, 22, 23, 48, 50–53, 116.1, 431, 432, 139/440, 441, 442, 170.3, 170.7, 195

See application file for complete search history.

(56) References Cited

U.S. PATENT DOCUMENTS

| | | | | |
|---|---|---|---|---|
| 4,138,157 | A * | 2/1979 | Pickett et al. | 297/472 |
| 4,481,981 | A * | 11/1984 | Motte | 139/426 R |
| 4,981,161 | A * | 1/1991 | Pickering et al. | 139/383 R |
| 5,436,044 | A * | 7/1995 | Pinkos | 428/36.1 |
| 6,085,802 | A * | 7/2000 | Silberberg | 139/387 R |
| 6,092,265 | A * | 7/2000 | Sesay | 24/200 |
| 6,112,775 | A * | 9/2000 | Hossli et al. | 139/383 R |
| 6,199,597 | B1 * | 3/2001 | David | 139/383 R |
| 6,705,244 | B1 * | 3/2004 | Berger et al. | 112/475.06 |
| 7,743,794 | B2 * | 6/2010 | Berger | 139/22 |
| 8,066,034 | B2 * | 11/2011 | Berger | 139/22 |
| 2002/0189701 | A1 * | 12/2002 | Berger et al. | 139/383 R |
| 2009/0223587 | A1 * | 9/2009 | Berger | 139/11 |
| 2010/0259090 | A1 * | 10/2010 | Berger | 297/468 |

FOREIGN PATENT DOCUMENTS

| | | |
|---|---|---|
| DE | 196 02 552 A1 | 8/1997 |
| EP | 1 514 962 A2 | 3/2005 |

OTHER PUBLICATIONS

DE 10 2009 058 039.5-26—Search Report—Jun. 9, 2010.

* cited by examiner

*Primary Examiner* — Bobby Muromoto, Jr.
(74) *Attorney, Agent, or Firm* — Brinks Hofer Gilson & Lione

(57) ABSTRACT

A seat belt webbing has a plurality of warp threads (1, 3), a weft thread (2) which runs from one edge of the seat belt webbing to the other edge, periodically reversing the direction in reversal points and is interwoven with the warp threads (1, 3).The weft thread (2) in the reversal points in an edge portion (B) is folded back forming a loop, and a catch thread (5) which is fed through the loops of the weft thread (2).The catch thread (5) is placed between the warp threads (1, 3) and is covered by the weft thread (2) and/or by the warp threads (1, 3) towards the surface of the seat belt webbing.

5 Claims, 1 Drawing Sheet

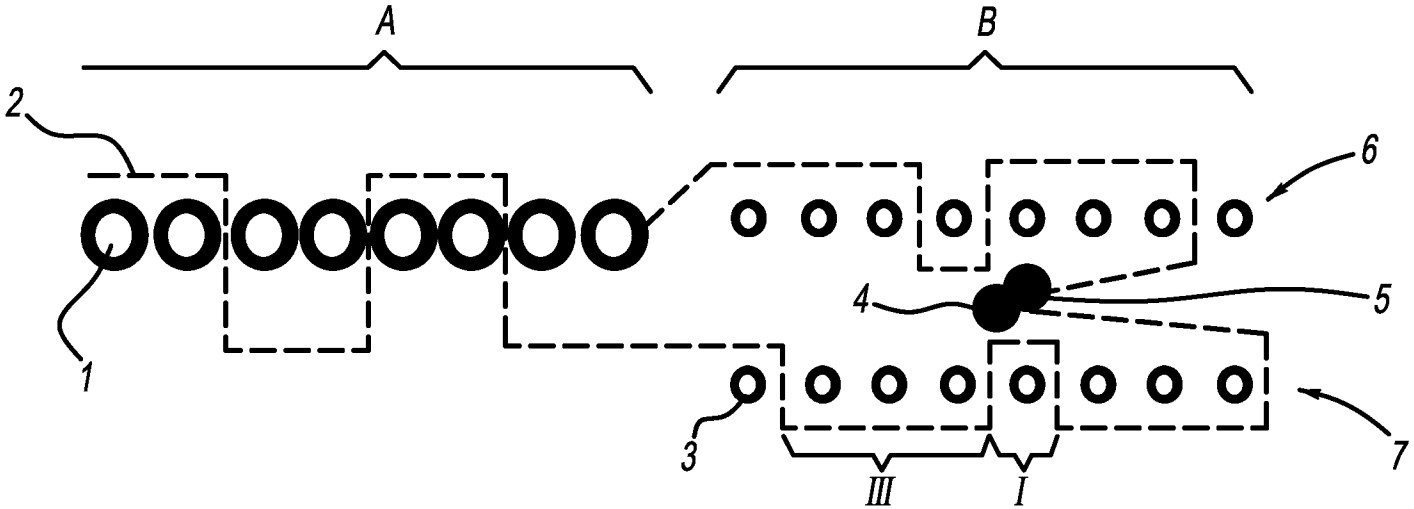
A
B
1
2
3
4
5
6
7
I
III

SEAT BELT WEBBING AND METHOD FOR MANUFACTURING THE SAME

FIELD OF THE INVENTION

The invention relates to a seat belt webbing and a method for manufacturing the same for a motor vehicle restraint system.

BACKGROUND OF THE INVENTION

Seat belts are used for example in motor vehicles, aircrafts and other mobile devices for restraining the occupant. To perform their function, the seat belts need to have a predetermined tensile strength. Furthermore, the seat belts should generally comprise a surface having as low friction as possible and a soft edge, in order that the occupant is obstructed by the seat belt as little as possible and the clothes of the occupant are not damaged.

The seat belt webbing comprises a plurality of warp threads running in the longitudinal direction which are connected with each other by a weft thread running transversely to the warp threads. During the weaving process, the weft thread is shot through the warp threads from one side of the belt webbing using a weft needle and is caught on the other side using a catch thread, so that when the weft needle is retracted the weft thread is not retracted with it. In the case of loading the seat belt webbing during an accident the warp threads are the load-bearing threads and therefore need to have a certain tensile strength, whereas the weft thread is loaded to a lesser extent and essentially forms the surface of the belt webbing. Thus, the weft thread should have better surface properties than the warp threads, however, in the sense of a softer surface may have a lower tensile strength than the warp threads.

From EP 1 514 962 A2, a belt webbing is known, which in the edge regions comprises warp threads having a different shrinkage characteristic than the warp threads in the central region. In the successive shoots, the weft thread is interwoven with a varying number of warp threads, so that in the edge region certain warp threads, for example at every fourth or fifth shoot only, are looped around by the weft thread. After weaving the belt webbing it is subjected to a heat treatment, during which a soft edge is formed by intentionally shrinking the warp threads differently in the edge region.

Furthermore, seat belt webbings are known, in which the warp threads in the edge region are designed to be considerably finer than the warp threads in the central region. Owing to the finer warp threads in the edge region, the edge of the seat belt webbing is softer and the surface of the seat belt webbing is considerably more homogeneous, so that the sawing effect of the seat belt webbing when rubbing against the edge is considerably reduced.

It is the object of the invention to provide an enhanced seat belt webbing comprising a soft edge and a method for manufacturing the same.

SUMMARY OF THE INVENTION

For the solution of the object, it is proposed according to the invention that the catch thread is placed between the warp threads and is covered by the weft thread and/or the warp threads towards the surface of the seat belt webbing.

The catch thread itself in the seat belt webbing has the function to retain the weft thread in the reversal points during the weaving process, which is why it has to have a certain tensile strength, in order that it does not tear during the weaving process and consequently the weaving process needs to be interrupted. Surprisingly, the catch thread appearing on the surface has turned out to have a crucial co-influence on the hardness of the edge. Due to its function, the properties of the catch thread differ from the properties of the weft thread, so that owing to the catch thread appearing on the surface between the weft threads the surface becomes inhomogeneous, and the sawing effect of the edge when rubbing for example against the clothes of the occupant is increased. Due to the solution according to the invention the surface of the edge is now defined by the weft thread and/or by the warp threads only, as the catch thread is placed between the warp threads and is covered by the weft threads and/or the warp threads. The catch thread thus is no longer visible from the outside. A further advantage resulting from the invention is that both edges of the seat belt webbing thus are nearly identical, even if a weaving technique is used, in which a catch thread is provided on one side only, and the weft thread is inserted from one side only.

It generally is a disadvantage of inhomogeneous sides of the seat belt webbing that they wear away differently, and the seat belt webbing thus, after long-time wearing, gives the optical impression to the beholder of being of lower value. Furthermore, when the belt webbing is mounted with a misalignment the inhomogeneous edges may lead to an undesired noise occurring in the seat belt retractor during the retraction movement and extraction movement of the seat belt webbing. For this reason, when mounting the belt webbing in the seat belt retractor specific cost-incurring measures need to be taken, in order to prevent the seat belt webbing from being mounted incorrectly with a misalignment. Inhomogeneous edges further result in the seat belt webbing making additional noise when being pulled through the deflector, in the retraction forces and extraction forces of the seat belt webbing changing disadvantageously and in the belt bearing surface of the deflector being worn away unequally.

DESCRIPTION OF THE DRAWING

In the following, the invention is described in more detail on the basis of a preferred embodiment.

FIG. 1 shows a seat belt webbing according to the invention comprising a catch thread which is placed between the warp threads.

DETAILED DESCRIPTION OF THE INVENTION

The seat belt webbing may be subdivided into a center portion A and an edge portion B. In the center portion A, warp threads 1 are provided, which have a thread size of 900 to 2100 dtex and are designed as multifilaments comprising filaments which are not twisted or filaments which are twisted with up to 150 twists per meter length. The warp threads 1 have the function to absorb the tensile forces acting during the accident and, therefore, are particularly strong and thus also relatively stiff. In the edge portion B, finer warp threads 3 having a thread size of 400 to 1100 dtex are provided, which as well are designed as multifilaments comprising for example 28 filaments. The filaments further are twisted with each other up to 150 times per meter length.

Furthermore, a weft thread 2 is provided, which, while the belt webbing is woven, with a weft needle is shot from one side through a shed formed by two layers of warp threads 1 and 3 which are aligned at an angle relative to each other. At an edge of the seat belt webbing, the weft thread 2 is caught using a catch thread 5 and is crocheted with the same via a knitting needle. The weft thread 2 as well is designed as a multifilament having a thread size of 280 to 1100 dtex and comprises for example 96 filaments which are twisted with each other 130 times per meter length. Owing to the great number of filaments the weft thread 2 is particularly self-moveable, so that with the weft thread a particularly soft and homogeneous surface can be obtained. The catch thread 5 is designed as a multifilament as well and has a thread size of 280 dtex and comprises 48 filaments with 80 twists per meter. Furthermore, a lock thread 4 is provided, which is guided together with the catch thread 5 and provides a better coherence of the textile composite in the seat belt webbing.

As can be seen in FIG. 1, the finer warp threads 3 of the edge portion B are interwoven with the weft thread 2 to form two layers 6 and 7 each with the weaving pattern being formed in such a way that, on one side, three warp threads 3 in a package III and, on the other side, one warp thread 3 in a package I are alternately passed by the weft thread 2. The weft thread 2 is a single thread which during the weaving process is guided in a periodic to-and-fro motion and thereby effects the cross connection of the warp threads 1 and 3 and further forms at least a major part of the surface of the seat belt webbing.

At every second shoot, the weft thread 2 is only guided past the warp threads 3 and subsequently, when moving backwards, pulls the catch thread 5 to such an extent into the edge portion B that, in the finish-woven seat belt webbing, the same gets to rest between the warp threads 3 and is covered by the weft thread 2 towards the surface. The catch thread 5 preferably is only pulled into the edge portion B maximally up to the edge of the center portion A between the finer warp threads 3, as the weave of the warp threads 1 to the weft thread 2 in the center portion A differs from the weave of the finer warp threads 3 to the weft thread 2 in the edge portion B. After said shoot of the weft thread 2, the weft thread 2 at the next shoot is shot through at least a partial number of the warp threads 3, preferably through one of the layers 6 or 7, is then caught by the catch thread 5 and, while moving backwards, pulls the catch thread 5 as well as some of the warp threads 3 up to the center portion A. Thus, at the edge of the center portion A an overall soft edge with an inside catch thread 5 is generated, the exterior surface of which edge is formed by the weft thread 2 and the finer warp threads 3 only. As a result, an identical surface structure of the edges of the seat belt webbing is generated, even if the weft thread 2 is caught by the catch thread 5 on one side only, as the catch thread 5 is placed between the finer warp threads 3 and, towards the surface, is covered all over by the weft thread 2, and thus does not appear on the surface.

In particular, the tensile load in the catch thread 5 should be chosen in such a way that the weft needle can pull back the catch thread 5 together with the weft thread 2 with the retraction or carry-along movement being automatically restrictable by the varying weave of the warp threads 1 and 3. The weave of the warp threads 1 and 3 is the weaving pattern formed by the weft thread 2 which is shot through and the warp threads 1 and 3 which are moved thereby individually or together in groups. The weaving pattern in the present seat belt webbing in the center portion A is formed by two paired warp threads 1 each, which are alternately passed by the weft thread 2 on different sides. The weaving pattern and thus the weave of the warp threads 3 in the edge portion B is formed by the alternating groups I and III which are formed from three warp threads 3 or one single warp thread 3 each and are passed by the weft thread 2 on different sides. The movement of the warp threads 1 and 3 between each single shoot of the weft thread 2 here is not described in detail. However, knowing the commonly used weaving technique, the same can easily be deduced.

The proposed weave of the warp threads 3 in the edge portion B has turned out to be advantageous insofar as an edge can be obtained thereby having a thickness which is essentially identical to the thickness of the seat belt webbing in the center portion A.

The proposed seat belt webbing in particular provides the advantage that it comprises at least two nearly identical soft edges and, though, can be woven with one weft thread 2 only and a one-side guided catch thread 5. Thereby, considerably higher working speeds can be obtained than is possible with belt webbings comprising soft edges according to the prior art. The loom can be operated with approx. 1500-1600 U/min resulting in the manufacturing costs of the seat belt webbing being significantly lower than for comparable seat belt webbings comprising soft edges.

A further advantage resulting from the invention is that the catch thread 5 is no longer allocated to a certain group of warp threads 1 or 3, as is the case in the prior art. The catch thread 5 loses its orientation and is intentionally placed between the warp threads 1 and 3 without a predetermined orientation, so that the seat belt webbing in the area of the edge no longer shows a hardness distribution which is defined by the catch thread 5 appearing on the surface of the seat belt webbing.

While the above description constitutes the preferred embodiment of the present invention, it will be appreciated that the invention is susceptible to modification, variation, and change without departing from the proper scope and fair meaning of the accompanying claims.

The invention claimed is:

1. Seat belt webbing comprising:

a plurality of warp threads (1, 3), a weft thread (2) which runs from one edge of the seat belt webbing to the other edge of the seat belt webbing periodically reversing the direction at reversal points and is interwoven with the warp threads (1, 3), wherein the weft thread (2) in the reversal points in an edge portion (B) of the webbing is folded back forming a loop, and a catch thread (5) which is fed through the loops of the weft thread (2), wherein the catch thread (5) is placed between the warp threads (1, 3) and is covered by the weft thread (2) or the warp threads (1, 3) towards the surface of the seat belt webbing, wherein in the edge portion (B), the threads of the warp threads (3) are finer than the threads of a center portion (A) of the seat belt webbing, and the weft thread (2) is woven through the warp threads (3) of the edge portion (B) in a repeating weaving pattern formed by three of the warp threads (3) in a row on one side (III) followed by one warp thread (3) on the other side (I).

2. The seat belt webbing according to claim 1 further comprising that the finer warp threads (3) in the edge portion (B) are interwoven in at least two layers (6, 7).

3. The seat belt webbing according to claims 1 further comprising that the catch thread (5) is placed between the finer warp threads (3) of the edge portion (B).

4. The seat belt webbing according to claim 1 further comprising that the tensile forces in the catch thread (5) and in the weft thread (2) are dimensioned in such a way that the weft thread (2) while moving backwards carries along the catch thread (5).

5. The seat belt webbing according to claim 1 further comprising that the movement of carrying along the catch thread (5) is restricted by the varying weave of the warp threads (1, 3).

* * * * *